US011358778B2

(12) United States Patent
Rice et al.

(10) Patent No.: US 11,358,778 B2
(45) Date of Patent: Jun. 14, 2022

(54) MOISTURE CONTROL DEVICES

(71) Applicant: Boveda, Inc., Minnetonka, MN (US)

(72) Inventors: Brian Rice, Greenfield, MN (US); Robert L. Esse, Monticello, MN (US); David Egberg, Bonita Springs, FL (US)

(73) Assignee: Boveda Inc., Minnetonka, MN (US)

( * ) Notice: Subject to any disclaimer, the term of this patent is extended or adjusted under 35 U.S.C. 154(b) by 0 days.

(21) Appl. No.: 16/119,116

(22) Filed: Aug. 31, 2018

(65) Prior Publication Data

US 2019/0071235 A1 Mar. 7, 2019

Related U.S. Application Data

(60) Provisional application No. 62/553,242, filed on Sep. 1, 2017.

(51) Int. Cl.
*B65D 81/26* (2006.01)
*A61J 1/03* (2006.01)

(52) U.S. Cl.
CPC ..... *B65D 81/268* (2013.01); *A61J 1/03* (2013.01)

(58) Field of Classification Search
CPC ..... B65D 81/268; A61J 1/03
USPC ..... 206/204
See application file for complete search history.

(56) References Cited

U.S. PATENT DOCUMENTS 5,603,401 A * 2/1997 Brunner ..... B65D 25/16 206/204
5,936,178 A * 8/1999 Saari ..... A24F 25/02 84/453
2006/0144726 A1* 7/2006 Foust ..... B65D 43/162 206/204
2008/0257151 A1* 10/2008 Mayer ..... B01D 53/261 95/90
2013/0189330 A1* 7/2013 Tani ..... A23L 33/185 424/400
2015/0004287 A1* 1/2015 Crump ..... B65D 81/268 426/118
2016/0023818 A1* 1/2016 Gelov ..... B65D 47/0838 220/254.1
2016/0114945 A1* 4/2016 Carsello ..... B65D 51/244 222/152
2016/0229604 A1* 8/2016 Carsello ..... B65D 51/244
2018/0099797 A1* 4/2018 Biesecker Longacre ..... B65D 50/04

* cited by examiner

*Primary Examiner* — Rafael A Ortiz
(74) *Attorney, Agent, or Firm* — Padda Law Group

(57) ABSTRACT

The present disclosure relates to a humidity control device having a capsule and a humidity control agent arranged within the capsule. The capsule may have a sidewall arranged between a pair of end portions, and at least one end portion may be an endcap coupled to the sidewall. Further, the capsule may have at least one vapor permeable and liquid impermeable surface. The humidity control device may be configured to control relative humidity within an enclosure to a particular level or to within a particular range. The humidity device may be sized and configured to control humidity within a relatively small and/or uniquely shaped enclosure, such as a container for a single cigar or rolled cannabis product, for example.

15 Claims, 6 Drawing Sheets

MOISTURE CONTROL DEVICES

CROSS-REFERENCE TO RELATED APPLICATIONS

The present disclosure claims priority to Provisional Application No. 62/553,242, entitled Moisture control Device with Osmosis Filling, and filed Sep. 1, 2017, the content of which is hereby incorporated by reference herein in its entirety.

FIELD OF THE INVENTION

The present disclosure relates to novel and advantageous devices and methods for controlling humidity. Particularly, the present disclosure relates to novel and advantageous devices and methods for controlling humidity within a desired range or at a desired level. More particularly, the present disclosure relates to novel and advantageous devices and methods for controlling humidity within a relatively small container, such as a medicinal or pharmaceutical container, or cigar or cannabis product containers.

BACKGROUND OF THE INVENTION

The background description provided herein is for the purpose of generally presenting the context of the disclosure. Work of the presently named inventors, to the extent it is described in this background section, as well as aspects of the description that may not otherwise qualify as prior art at the time of filing, are neither expressly nor impliedly admitted as prior art against the present disclosure.

Many products and items benefit from a controlled humidity environment. In particular, many products and items benefit from an environment having a humidity content, such as a relative humidity, within a particular range or at a particular level. Some products and items can spoil, become damaged, become unusable, or lose freshness when subject to environments with too much or too little humidity. For example, tobacco products, such as cigars or loose tobacco, can benefit from an environment with a controlled humidity. Cannabis products, such as loose cannabis, pre-rolled cannabis products, or other products can benefit from an environment with a controlled humidity. Pharmaceutical or medicinal products can benefit from a control humidity environment. Food products may also benefit from such environments. Instruments, such as stringed instruments, can also benefit from such environments. Many other products and items may benefit from a controlled humidity as well.

Additionally, some products may require a particular humidity level or range in order to remain safe for consumers. For example, some products may need to be kept at or below a particular humidity level in order to ensure they are safe for consumption. In some cases, particular rules, regulations, or product specifications may designate a safe or required humidity level or humidity range for products.

To help maintain a desired or required humidity level or range for products, it may be desirable to control a humidity level within a product package or container in which such products or items are stored. Conventionally, products are often provided with desiccants or moisture absorbing materials to dehumidify a product package environment. However, desiccants alone do not control humidity within a desired range or at a desired rate. Additionally, it may be difficult to control humidity within a relatively small and/or uniquely shaped package, such as a container for a single cigar, for example.

BRIEF SUMMARY OF THE INVENTION

The following presents a simplified summary of one or more embodiments of the present disclosure in order to provide a basic understanding of such embodiments. This summary is not an extensive overview of all contemplated embodiments, and is intended to neither identify key or critical elements of all embodiments, nor delineate the scope of any or all embodiments.

The present disclosure, in one or more embodiments, relates to a humidity control device. The humidity control device may have a capsule with a sidewall arranged between a pair of end portions. At least one end portion may have an endcap coupled to the sidewall, and the capsule may have at least one vapor permeable and liquid impermeable surface. Additionally, a humidity control agent may be arranged within the capsule. In some embodiments, the sidewall may be a cylindrical sidewall having a diameter of no more than approximately 2 cm. In some embodiments, the capsule may have a height of no more than approximately 5 cm. The endcap may be coupled to the sidewall using a friction fit mechanism, a snap fit mechanism, and/or an adhesive. However, in other embodiments, the endcap and sidewall may be molded together as a single component. The humidity control agent may include a salt solution, glycerol, and/or a sugar solution. In some embodiments, the humidity control agent may include a liquid, a gel, a powder, or a tablet. The humidity control device may be configured to control humidity within an enclosure within a relative humidity range of between approximately 30% and approximately 85%. The endcap may be vapor permeable and liquid impermeable in some embodiments. The endcap may include a poly-fluorocarbon material in some embodiments.

The present disclosure, in one or more embodiments, additionally relates to a product package for storing a consumer product therein, the product package having a humidity control device arranged therein. The humidity control device may include a capsule having a sidewall arranged between two end portions. At least one end portion may have an endcap coupled to the sidewall, and the capsule may have at least one vapor permeable and liquid impermeable surface. A humidity control agent may be arranged within the capsule. In some embodiments, the product package may include a cylindrical container having a height of no more than approximately 5 inches, and the consumer product may include a tobacco or cannabis product. In other embodiments, the product package may include a pharmaceutical bottle and the consumer product may include a pharmaceutical or medicinal product. In some embodiments, the sidewall of the capsule may be a cylindrical sidewall having a diameter of no more than approximately 2 cm, and the capsule may have a height of no more than approximately 5 cm.

The present disclosure, in one or more embodiments, additionally relates to a method of manufacturing a humidity control device. The method may include the steps of filling a vapor-permeable and liquid-impermeable capsule with a quantity of a humidity control agent, and sealing the filled capsule. The humidity control agent may include a liquid, gel, powder, or tablet. In some embodiments, sealing the filled capsule may include coupling an endcap to the capsule. In some embodiments, the method may include exposing the sealed capsule to an environment with at least 20% relative humidity.

While multiple embodiments are disclosed, still other embodiments of the present disclosure will become apparent to those skilled in the art from the following detailed description, which shows and describes illustrative embodiments of the invention. As will be realized, the various embodiments of the present disclosure are capable of modifications in various obvious aspects, all without departing from the spirit and scope of the present disclosure. Accordingly, the drawings and detailed description are to be regarded as illustrative in nature and not restrictive.

BRIEF DESCRIPTION OF THE DRAWINGS

While the specification concludes with claims particularly pointing out and distinctly claiming the subject matter that is regarded as forming the various embodiments of the present disclosure, it is believed that the invention will be better understood from the following description taken in conjunction with the accompanying Figures, in which:

DETAILED DESCRIPTION

For many packaged products, including consumer products, it may be beneficial to maintain a particular moisture or humidity content or range within the container. Form-fill-seal pouches or other pouches or containers may be filled with a quantity of a humidity control agent, such as those descried in U.S. Pat. No. 5,936,178. Such pouches or containers may be constructed of materials having a water vapor transmission rate of approximately 30 grams/100 square inches/24 hours, or higher or lower rates, under standard test conditions. However, it may be difficult to produce such humidity control pouches or containers for relatively small of uniquely shaped enclosures. For example, where a relatively small cylindrical enclosure is configured to store a single cigar or a single rolled cannabis product, it may be beneficial to control the humidity therein. However, the humidity control pouches described above may not fit within such an enclosure.

The present disclosure relates to novel and advantageous devices and methods for controlling humidity. In particular, the present disclosure relates to novel and advantageous devices and methods for controlling humidity in relatively small packaging environments, such as single cigar cases, pharmaceutical bottles, single rolled cannabis product containers, and/or other relatively small or unusually shaped containers. Devices of the present disclosure may be configured to control humidity to a desired rate or to within a desired humidity range. In particular, humidity control devices of the present disclosure may be configured to both absorb and release moisture, so as to provide two-way humidity control. A humidity control device of the present disclosure may be or include a relatively small capsule having a quantity of a humidity control agent arranged therein. The humidity control agent may be a liquid, gel, tablet, powder, or other suitable substance. In some embodiments, the capsule may contain between approximately 0.5 ml and 6 ml of humidity control agent, or between approximately 0.5 grams and approximately 2 grams of humidity control agent. Moreover, a humidity control device of the present disclosure may be filled using any suitable method. For example, a quantity of liquid or gel humidity control agent may be arranged in the capsule through an open end portion, and the capsule may be sealed with an endcap. In other embodiments, a quantity of a dry or solid humidity control agent may be arranged in the capsule through an open end portion, the capsule may be sealed with an endcap, and the capsule may be exposed to moisture such that the solid or dry agent may absorb the moisture.

Figure 1:
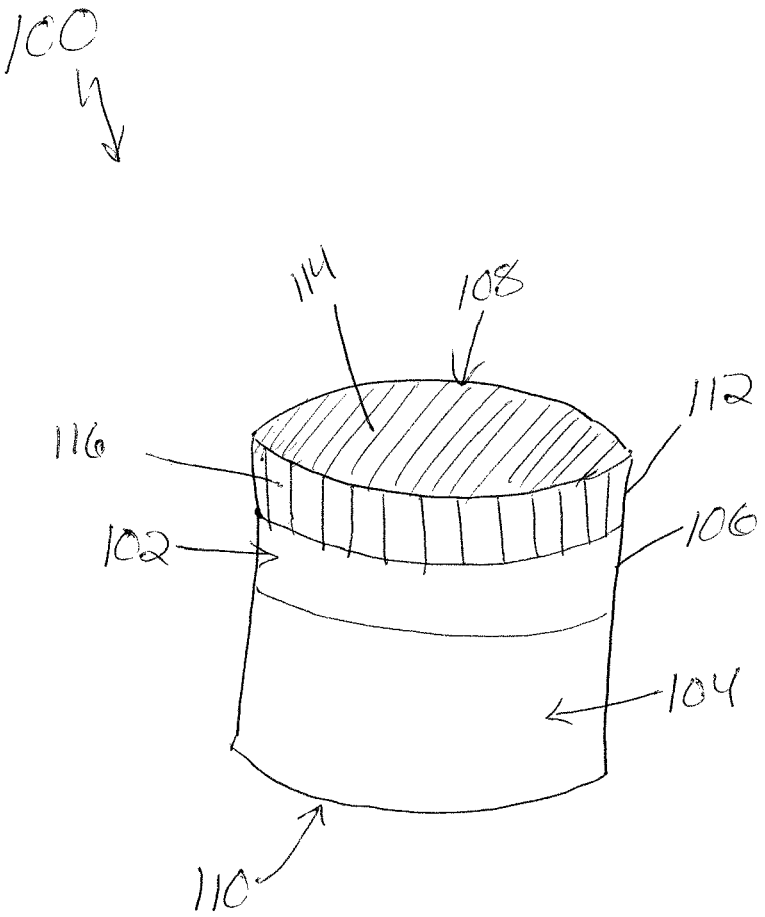
FIG. 1 is a perspective view of a humidity control device of the present disclosure, according to one or more embodiments.
Figure 2:
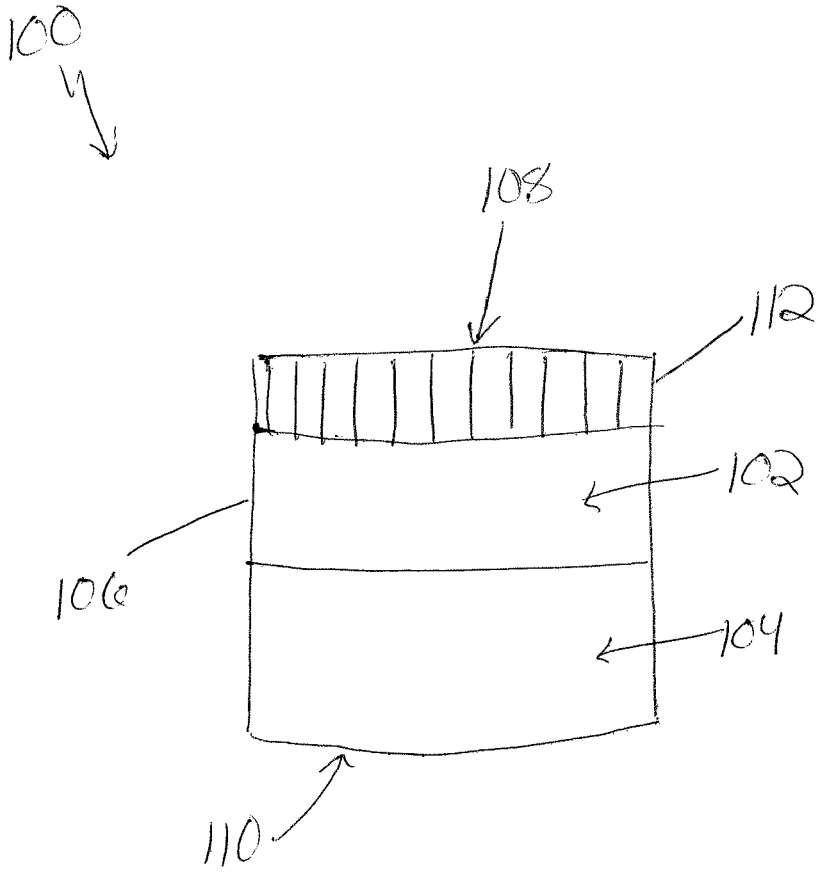
FIG. 2 is a side view of a humidity control device of the present disclosure, according to one or more embodiments.
Figure 3:
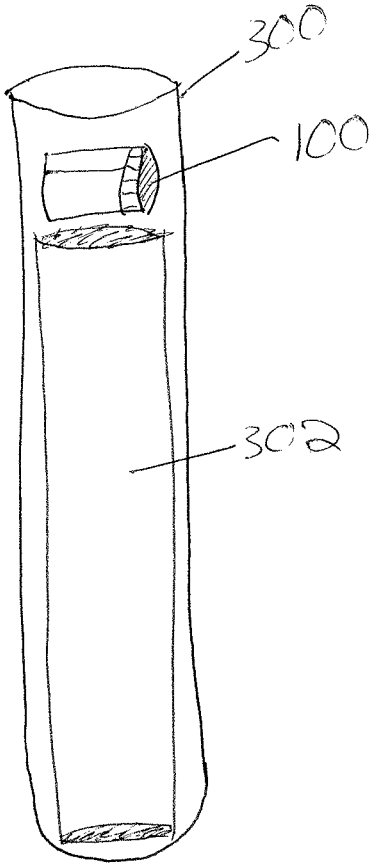
FIG. 3 is a side view of a container having a cigar or pre-rolled cannabis cigarette and a humidity control device arranged therein, according to one or more embodiments.
Figure 4:
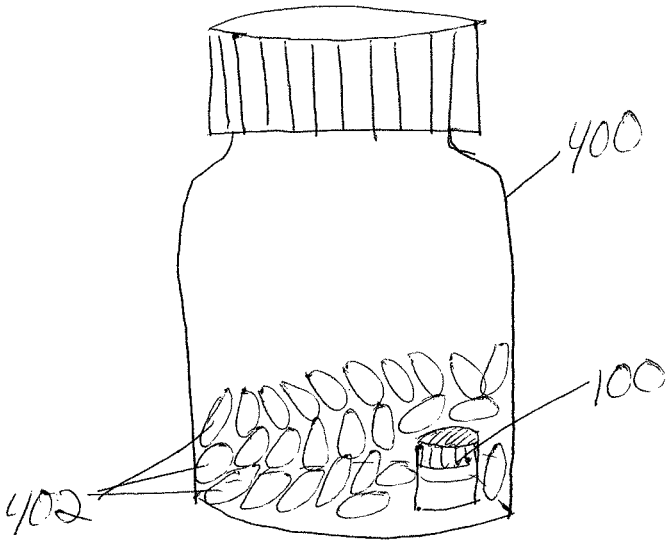
FIG. 4 is a side view of a pharmaceutical container having pharmaceutical pills and a humidity control device arranged therein, according to one or more embodiments.

Turning now to FIGS. 1 and 2, a humidity control device 100 of the present disclosure is shown, according to one or more embodiments. A humidity control device 100 of the present disclosure may generally be or include a capsule 102 having a quantity of a humidity control agent 104 arranged therein. The device 100 may be configured for arranging within a product packaging or within any suitable enclosure or container for controlling a relative humidity therein. For example, FIG. 3 shows an enclosure 300, which may be configured for holding a cigar 302. As shown in FIG. 3, the humidity control device 100 may be arranged in the enclosure 300 with the cigar 302. The humidity control device 100 may be configured to control humidity within the enclosure 300 to a desired level or a desired range so as to help maintain freshness or integrity of the cigar 302. As another example, FIG. 4 shows another enclosure 400, which may be a pharmaceutical bottle, having a plurality of pharmaceutical pills 402 (such as tablets, capsules, or other pills) arranged therein together with the humidity control device 100. The humidity control device 100 may be configured to control humidity within the pharmaceutical bottle 400 to a desired level or a desired range so as to help maintain freshness or integrity of the pills 402.

The capsule 102 may be configured to contain the humidity control agent 104 therein, so as to prevent the humidity control agent from leaking or otherwise contacting products contained in the product packaging or other enclosure in which humidity is controlled. The capsule 102 may further be configured to allow water vapor to pass therethrough such that moisture may be both absorbed by the humidity control agent from the enclosure environment, and released by the humidity control agent into the enclosure environment. In this way, the capsule 102, or one or more portions or surfaces thereof, may be vapor permeable, but liquid impermeable. The capsule 102 may include two end portions 108, 110 and one or more sidewalls 106 extending between the two end portions.

In some embodiments, as shown in FIGS. 1 and 2, the capsule 102 may generally have a cylindrical shape with a single sidewall 106 defining a cylindrical shape between the end portions 108, 110. However, in other embodiments, the capsule 102 may have any other suitable shape. For example, the capsule 102 may have a generally cube or cuboid shape. For example, the capsule 102 may have four square or rectangular sidewalls 106. In other embodiments, the capsule 102 may have other shapes. The capsule 102 may have a spherical shape, a pyramid shape, or any other suitable shape with any suitable number of sidewalls 106.

Each end portion 108, 110 may be an open end, generally defined by the sidewall(s) 106, or may be a closed end. The end portions 108, 110 may be arranged on opposing ends or opposing faces of the capsule 102. In some embodiments, an open end portion, such as end portion 108 shown in FIGS. 1 and 2, may have an endcap 112 or plug arranged therein. The endcap 112 may be sized and shaped to enclose an opening defined by the sidewall(s) 106 at the open end portion 108. For example, where the capsule 102 has a sidewall 106 defining a cylindrical shape, the endcap 112 may have a circular shape with a diameter equal or similar to a diameter defined by the cylindrical sidewall. As another example, where the capsule 102 has four square sidewalls 106 defining a cube shape, the endcap 112 may have a square shape with a width equal or similar to a width of the four sidewalls. In some embodiments, the endcap 112 may have a flattened surface or face 114. In other embodiments, an endcap may have a convex or concave curved face 114. For example, the endcap 112 may have a face 114 that curves outward. In some embodiments, the endcap 112 may have one or more sidewalls 116 extending from the face 114 and configured to engage the sidewall(s) 106 of the capsule 102. For example, an endcap 112 with a round face 114 may have a circular sidewall 116 sized and configured to engage, or be arranged proximate to, the sidewall 106 of the capsule 102. In some embodiments, the device 100 may have two endcaps 112 arranged at each of two opposing open end portions. In still further embodiments, the device 100 may have additional endcaps 112 arranged at different openings or open ends of the device.

The endcap 112 may be configured to couple to the sidewall(s) 106 of the capsule 102. In some embodiments, one or more endcaps 112 may be configured to fixedly couple to the sidewall(s) 106, while one or more endcaps may be configured to removably couple to the sidewall(s). In some embodiments, one or more endcaps 112 may couple to the sidewall(s) 106 using an adhesive, a pressure fit mechanism, a snap fit mechanism, threading arranged on the endcap and sidewall(s), and/or any other suitable coupling mechanism.

The capsule 102 may be sized to be arranged within a relatively small enclosure, such as a single cigar case, a pharmaceutical bottle, or another type of enclosure. For example, the humidity control device 100 may have a height extending between the end portions 108, 110 of between approximately 0.5 cm and approximately 10 cm, or between approximately 1 cm and approximately 5 cm, or between approximately 1 cm and approximately 3 cm. The humidity control device 100 may have a diameter or width, perpendicular to the height, of between approximately 0.1 cm and approximately 6 cm, or between approximately 0.5 cm and approximately 3 cm, or between approximately 1 cm and approximately 2 cm. Each of the sidewall(s) 106 and endcaps 112 may have any suitable thickness. In some embodiments, the sidewall(s) 106 and/or endcaps 112 may have a wall thickness of between approximately 0.1 mm and approximately 1 mm. In at least one embodiments, a humidity control device 100 of the present disclosure may have a height of about 2 cm, a diameter or width of about 1.4 cm, and a wall thickness of about 0.3 mm. The humidity control device 100 may define a volume of approximately 2 milliliters in some embodiments.

The capsule 102 may be constructed of one or more plastics, such as one or more polypropylenes, high, medium, or low density polyethylene, and/or any other suitable plastics. In some embodiments, one or more components or surfaces of the capsule 102 may be constructed using a porous material or a material having a plurality of holes or openings. In particular, a capsule material may have a pore or opening size configured to allow water vapor, but not liquid, to pass therethrough. Pore diameter may be about 0.0625 inches or smaller in some embodiments. In other embodiments, a capsule material may have pores or openings of any other suitable size configured to allow water vapor, but not liquid, to pass therethrough. In some embodiments, one or more endcaps 112 or end portions 108, 110 may be configured to be porous or may have a porous surface so as to allow water vapor to pass therethrough. Additionally, in some embodiments, one or more components or surfaces of the capsule 102 may be constructed using a material with hydrophobic properties. Additionally or alternatively, one or more components or surfaces of the capsule may be constructed using a material coated or treated with a hydrophobic material. In some embodiments, one or more endcaps 112 may be configured with hydrophobic properties. In some embodiments, the capsule 102, or portions thereof, may be injection molded.

In some embodiments, one or more components or surfaces of the capsule 102 may be constructed of a polyfluorocarbon material such as polytetrafluoroethylene (PTFE). For example, one or more endcaps 112 may be constructed of PTFE or similar materials. It is to be appreciated that PTFE may have generally hydrophobic properties. Moreover, the PTFE may be configured to be porous. In some embodiments, the face 114 of an endcap 112 may be constructed of PTFE and the sidewall 116 of the endcap may be constructed using a stiffer material to allow for a pressure fit or otherwise to facilitate coupling to the sidewall(s) 106 of the capsule 102. For example, an endcap face 114 may be cut from a sheet of PTFE of defined porosity, and may be mounted to a stiffer endcap sidewall 116 to allow for a pressure fit with the capsule sidewall 106. In at least one embodiment, PTFE may be provided by POREX™ Corporation.

The capsule 102 may generally be sized and shaped to contain a quantity of humidity control agent 104, which may be a liquid humidity control agent in some embodiments. In other embodiments, however, a humidity control agent 104 may be a gel or have a relatively high viscosity, may be a paste, may be a powder or other solid, or may be in any other suitable form or consistency. The capsule 102 may be configured to contain between approximately 0.5 grams and approximately 2 grams of humidity control agent 104. In some embodiments, the capsule 102 may be configured to contain between approximately 0.5 ml and approximately 6 ml, or between approximately 1 ml and approximately 5 ml, or between approximately 2 ml and approximately 4 ml of humidity control agent 104. In some embodiments, the capsule 102 may be configured to contain approximately 3 ml of humidity control agent 104.

The humidity control agent 104 may be comprised of a solid, a dispersion, an emulsion, a gel, or a saturated or unsaturated aqueous solution comprised of a salt, sugar, polyol such as glycerin or propylene glycol, glycerol, mannitol, sorbitol, xylitol, amino acid, or other solute modulating the relative humidity. For example, in some embodiments, the humidity control agent 104 may be or include a saturated or unsaturated salt solution, such as those described in U.S. Pat. No. 9,750,811, entitled Devices and Methods for Controlling Headspace Humidity and Oxygen Levels, filed Sep. 15, 2015; U.S. Pat. No. 5,936,178, entitled Humidity Control Device, filed Jun. 10, 1997; and/or U.S. Pat. No. 6,921,026, entitled Preservation of Intermediate Moisture Foods by Controlling Humidity and Inhibition of Mold Growth, filed Feb. 5, 2002, the content of each of which is hereby incorporated herein by reference in its entirety. In other embodiments, other suitable materials for controlling humidity may be used as the humidity control agent 104. In at least one embodiments, the humidity control agent 104 may be comprised of a saturated aqueous salt with alkali metal formate therein, or may be comprised of a glycerol.

The humidity control agent 104 may allow for one-way or two-way humidity control in some embodiments. That is, the humidity control agent 104 may be configured to remove moisture from the air and/or to add moisture to the air with an enclosure. In some embodiments, one or more additives may be combined with the humidity control agent 104, including but not limited to the additives described in U.S. patent application Ser. No. 14/854,159, U.S. Pat. No. 5,936,178, and/or U.S. Pat. No. 6,921,026. For example, some additives may be used to increase or otherwise control viscosity levels of the humidity control agent 104. One example of an additives one or more gums for thickening or altering viscosity of the humidity control agent 104. For example, in some embodiments, between approximately 1% and approximately 3% of the humidity control agent may comprise one or more gums. Other additives may include one or more salts, water, and/or other additives.

In use, a humidity control device 100 of the present disclosure may be used to control atmospheric humidity within a relatively small and/or uniquely shaped product package or other enclosure. In some embodiments, an enclosure may have a volume of approximately 5 cubic inches or less. In one particular example, a humidity control device 100 of the present disclosure may be used to control humidity within a cylindrical container, such as the cigar 300 container shown in FIG. 3. The cylindrical container may have a height of approximately 5 inches and a diameter of less than 1 inch, such as a diameter of approximately 0.625 inches.

A humidity control device 100 of the present disclosure may provide up to approximately 1.5 grams of water vapor, or up to 1 gram, or up to 0.75 grams. It is to be appreciated that shape, dimensions, materials and/or other properties of the humidity control device 100 may be varied to achieve a desired moisture transfer capacity of the device. For example, where two endcaps 112 are constructed of PTFE or another suitable porous material, rather than a single endcap, the humidity control device 100 may provide for a higher moisture transfer capacity. Where additional surfaces or components are constructed of PTFE or another suitable porous material, the humidity control device 100 may have a higher or different moisture transfer capacity.

Figure 5:
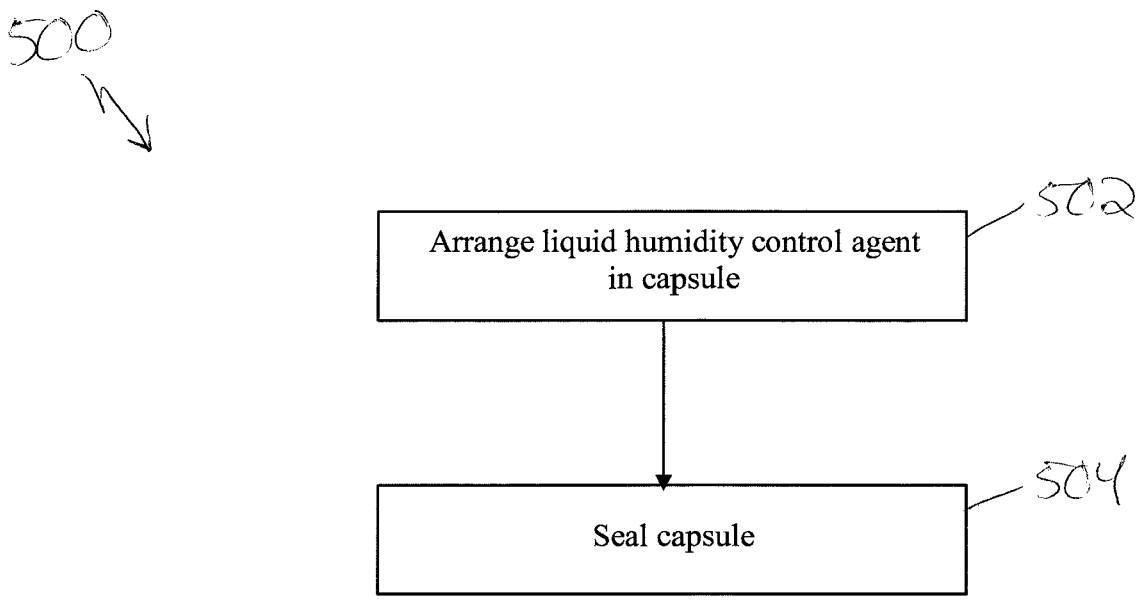
FIG. 5 is a flow diagram of method for filling a humidity control device of the present disclosure, according to one or more embodiments.

Various methods may be used to inject, insert, or otherwise arrange a humidity control agent 104 within a capsule 102 of the present disclosure. For example, FIG. 5 illustrates one embodiment of a method 500 for filling a capsule 102 of the present disclosure. As shown, the method 500 may generally include the steps of arranging a liquid humidity control agent 104 in a capsule 102 (502) and sealing the capsule (504). In other embodiments, the method 500 may include additional or alternative steps.

Arranging the liquid humidity control agent 104 in the capsule 102 (502) may generally include arranging a predefined or desired quantity of humidity control agent into the capsule. To accomplish this, the capsule 102 may be arranged generally upright with a closed end portion 110 facing downward and an open end portion 108 facing upward. A dropper, pipette, or other suitable filling system may be used to inject or insert a desired quantity of a liquid or gel humidity control agent 104, such as approximately 3 ml of solution, into the open capsule 102. In some embodiments, a plurality of capsules 102 may be arranged on a conveyer belt such that they may each be filled with the humidity control agent 104 in turn. While described as a liquid with respect to FIG. 5, it is to be appreciated that the humidity control agent 104 may be a viscous liquid or a gel, a paste, or even a solid in some embodiments.

Sealing the capsule 102 (504) may generally include arranging an endcap 112 over the open end 108 of the capsule. The endcap 112 may generally be coupled to the capsule 102 or otherwise sealed in place. For example, an adhesive material may be arranged between a sidewall 106 of the capsule 102 and the endcap so as to seal the endcap over the open end 108 of the capsule. Additionally or alternatively, the endcap 112 may be coupled to a sidewall 106 of the capsule 102 using a friction fit mechanism, snap fit mechanism, screw mechanism, and/or other suitable mechanism. In some embodiments, the endcap 112 may be heat sealed to the sidewall(s) 106 of the capsule 102.

Figure 6:
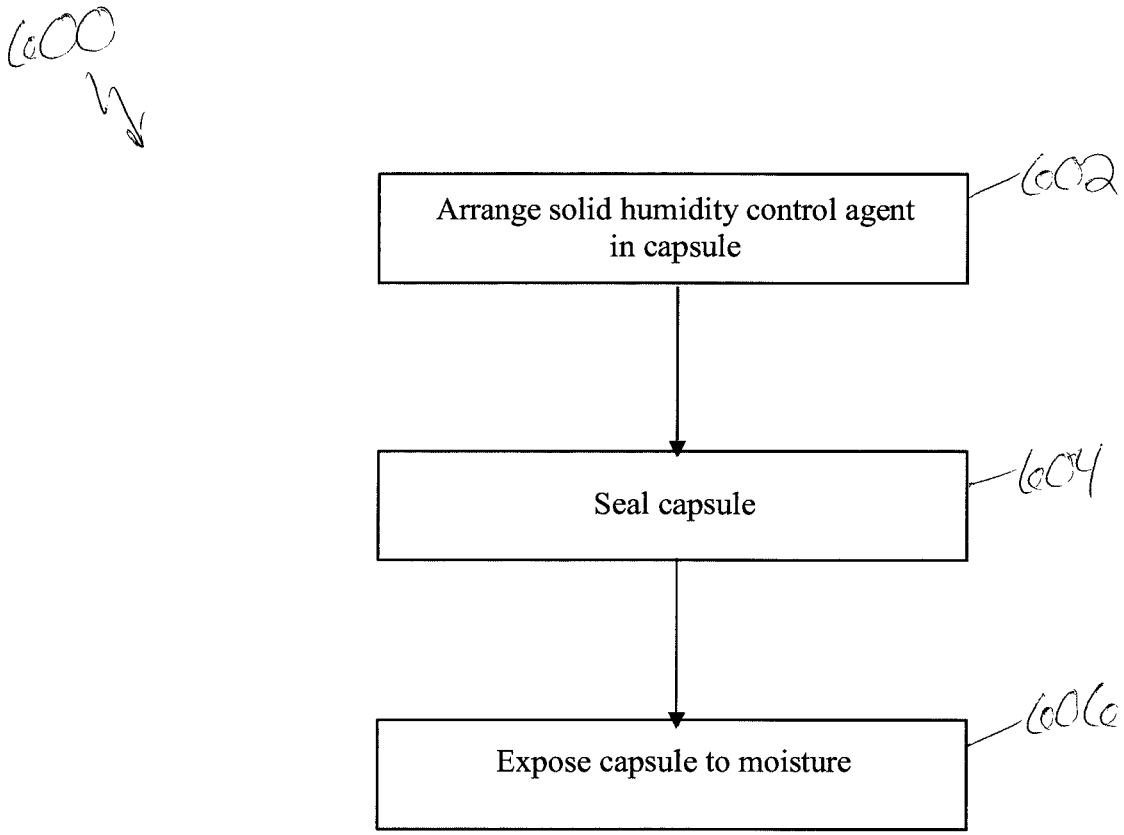
FIG. 6 is a flow diagram of another method for filling a humidity control device of the present disclosure, according to one or more embodiments.

Turning now to FIG. 6, another method 600 for filling a capsule 102 of the present disclosure is shown, according to one or more embodiments. The method 600 may generally include the steps of arranging a solid humidity control agent 104 in the capsule 102 (602), sealing the capsule (604), and exposing the capsule to moisture (606) to fill via osmosis until a desired fill weight is achieved. In other embodiments, the method 600 may include additional or alternative steps.

Arranging a solid humidity control agent 104 in the capsule 102 (602) may generally include arranging a predefined or desired quantity of humidity control agent into the capsule. For example, the humidity control 104 agent may be a quantity of powder in some embodiments. In other embodiments, the humidity control agent 104 may be a pressed tablet. In still other embodiments, the humidity control agent 104 may be in any other suitable form, in a solid state or in a different state. In some embodiments, the solid humidity control agent 104 may include tri-potassium citrate mono-hydrate, sodium formate, and/or magnesium chloride. As with the method 500 described above, the capsule 102 may be arranged generally upright with a closed end portion 110 facing downward and an open end portion 108 facing upward. The powder, tablet, or other form of humidity control agent 104 may be arranged in the capsule 102 through the open end portion 110. In some embodiments, a suitable amount of headspace may be provided in the capsule 102 to allow room for the solid humidity control agent 104 to expand upon absorbing moisture. Any suitable method or tool may be used to arrange the humidity control agent 104 in the capsule 102. For example, equipment used for filling blister packaging, or used with other medicinals, may be used to fill capsules 102 with tablets, according to some embodiments. For humidity control agents 104 in powder form, an auger type filler or volumetric cup filler may be used, for example.

Some or all ingredients used to create the powder and/or tablet humidity control agents 104 may be generally hygroscopic, and may be configured to absorb water vapor prolifically until a stage of equilibrium, or another suitable stage of hydration, has been reached. It may thus be appreciated, that the hydroscopic nature of the dry humidity control agents 104 and the capsule 102 properties providing for moisture transfer may allow the humidity control agents to be hydrated by exposing the filled capsules to moisture.

Sealing the capsule 102 (604) may generally include arranging an endcap 112 over the open end 108 of the capsule. The endcap 112 may generally be coupled to the capsule 102 or otherwise sealed in place. For example, an adhesive material may be arranged between a sidewall 106 of the capsule 102 and the endcap 112 so as to seal the endcap over the open end 108 of the capsule. Additionally or alternatively, the endcap 112 may be coupled to a sidewall 106 of the capsule 102 using a friction fit mechanism, snap fit mechanism, screw mechanism, and/or other suitable mechanism. In some embodiments, the endcap 112 may be heat sealed to the sidewall(s) 106 of the capsule 102.

Exposing the sealed capsule 102 to moisture (606) may include arranging the filled capsule in an environment having a suitable relative humidity. For example, the capsule 102 containing the solid tablet, powder, or other humidity control agent 104 may be exposed to up to 100% relative humidity at any suitable temperature. The filled capsule 102 may be exposed to an environment of at least 10%, at least 20%, at least 30%, at least 40%, at least 50%, at least 60%, at least 70%, at least 80%, at least 90%, or any other suitable amount of relative humidity. Moisture may pass through the capsule 102 until an appropriate or desired end point, or equilibrium, is reached. As moisture is absorbed by humidity control agent 104 in powder or tablet form, the powder or tablet may dissolve, partially dissolve, or distribute into loose granules. In some embodiments, the capsule 102 may be weighed to determine when a desired moisture level is reached. In other embodiments, the capsule 102 filled with dry agents may be exposed to, or submersed or partially submersed, in water or another liquid. In such embodiments, a drying step may be used to dry or partially dry the capsule 102 after exposure to the water.

As described above, humidity control devices of the present disclosure may generally be configured to control humidity to a particular moisture level or to within a particular range. In particular, humidity control devices of the present disclosure may be configured to both absorb and release moisture, so as to maintain humidity in an environment to the desired level or range. This provides an improvement over conventional desiccant or moisture absorbing materials that are only configured to absorb moisture in an environment, and thus are not generally capable of maintaining a particular moisture level or range. In some embodiments, a humidity control device of the present disclosure may be configured to maintain a relative humidity within a product package or other environment within a range of between approximately 20% and approximately 95% relative humidity, or between approximately 30% and approximately 90% relative humidity, or between approximately 40% and approximately 88% relative humidity, or between approximately 50% and approximately 80% relative humidity. In some particular embodiments, a humidity control device of the present disclosure may be configured to maintain a relative humidity within a product package or other environment at a level of approximately 30% relative humidity, 32% relative humidity, 35% relative humidity, 40% relative humidity, 45% relative humidity, 49% relative humidity, 50% relative humidity, 55% relative humidity, 58% relative humidity, 60% relative humidity, 62% relative humidity, 65% relative humidity, 67% relative humidity, 70% relative humidity, 72% relative humidity, 75% relative humidity, 80% relative humidity, 84% relative humidity, or 85% relative humidity Additionally, it is to be appreciated that a humidity control device of the present disclosure may be configured to contain a humidity control agent in the form of a liquid or gel. In this way, conventional containers configured to hold desiccants may be unacceptable, as such containers may have perforations or materials that are unsuitable for holding liquids. For example, conventional containers constructed of hydrophilic materials such as paperboard materials may not be suitable for containing a liquid, as the paperboard may become saturated and/or allow leaks.

It is further to be appreciated that humidity control devices of the present disclosure may be configured for use with relatively small and/or uniquely shaped product packages or other enclosures. That is, humidity control devices of the present disclosure may be relatively small in size, such that the devices may physically fit within small or unique product packages. Humidity control devices of the present disclosure may additionally contain a relatively small quantity of humidity control agent suitable for controlling humidity within relatively small enclosures. Conventional humidity control devices may be too large or otherwise may not be suited for use in small and/or uniquely shaped enclosures. It is further to be appreciated that manufacturing humidity control devices with such relatively small quantities of humidity control agent may be difficult, as it may be difficult to transfer such a small quantity of humidity control agent into the capsules.

Various embodiments of the present disclosure may be described herein with reference to flowchart illustrations and/or block diagrams of methods. Although a flowchart or block diagram may illustrate a method as comprising sequential steps or a process as having a particular order of operations, many of the steps or operations in the flowchart(s) or block diagram(s) illustrated herein can be performed in parallel or concurrently, and the flowchart(s) or block diagram(s) should be read in the context of the various embodiments of the present disclosure. In addition, the order of the method steps or process operations illustrated in a flowchart or block diagram may be rearranged for some embodiments. Similarly, a method or process illustrated in a flow chart or block diagram could have additional steps or operations not included therein or fewer steps or operations than those shown. Moreover, a method step may correspond to a method, a function, a procedure, a subroutine, a subprogram, etc.

As used herein, the terms "substantially" or "generally" refer to the complete or nearly complete extent or degree of an action, characteristic, property, state, structure, item, or result. For example, an object that is "substantially" or "generally" enclosed would mean that the object is either completely enclosed or nearly completely enclosed. The exact allowable degree of deviation from absolute completeness may in some cases depend on the specific context. However, generally speaking, the nearness of completion will be so as to have generally the same overall result as if absolute and total completion were obtained. The use of "substantially" or "generally" is equally applicable when used in a negative connotation to refer to the complete or near complete lack of an action, characteristic, property, state, structure, item, or result. For example, an element, combination, embodiment, or composition that is "substantially free of" or "generally free of" an element may still actually contain such element as long as there is generally no significant effect thereof.

To aid the Patent Office and any readers of any patent issued on this application in interpreting the claims appended hereto, applicants wish to note that they do not intend any of the appended claims or claim elements to invoke 35 U.S.C. § 112(f) unless the words "means for" or "step for" are explicitly used in the particular claim.

In the foregoing description various embodiments of the present disclosure have been presented for the purpose of illustration and description. They are not intended to be exhaustive or to limit the invention to the precise form disclosed. Obvious modifications or variations are possible in light of the above teachings. The various embodiments were chosen and described to provide the best illustration of the principals of the disclosure and their practical application, and to enable one of ordinary skill in the art to utilize the various embodiments with various modifications as are suited to the particular use contemplated. All such modifications and variations are within the scope of the present disclosure as determined by the appended claims when interpreted in accordance with the breadth they are fairly, legally, and equitably entitled.

What is claimed is:

1. A humidity control device comprising:

a capsule comprising:

a sidewall comprising a first material and defining a space, the side wall extending approximately 1 centimeter to 3 centimeters between a first end and a second end, the first end being open; and an endcap comprising a second material and coupled to the sidewall to seal the first end and enclose the space, wherein the second material comprises a vapor permeable and liquid impermeable material, the endcap having a width of between approximately 1 centimeter and 2 centimeters; and approximately 2 milliliters to approximately 4 milliliters of a humidity control agent arranged within the enclosed space of the capsule, wherein the humidity control agent provides two-way humidity control.

2. The humidity control device of claim 1, wherein the endcap is coupled to the sidewall using at least one of a friction fit mechanism and a snap fit mechanism.

3. The humidity control device of claim 1, wherein the endcap is coupled to the sidewall using an adhesive.

4. The humidity control device of claim 1, wherein the humidity control agent comprises at least one of salt solution, glycerol, and a sugar solution.

5. The humidity control device of claim 1, wherein the humidity control agent comprises a liquid, gel, powder, or tablet.

6. The humidity control device of claim 1, wherein the humidity control device is configured to control humidity within an enclosure within a relative humidity range of approximately 30% to approximately 85%.

7. The humidity control device of claim 1, wherein the endcap comprises a porous polyfluorocarbon material.

8. A method of manufacturing a humidity control device, the method comprising:

inserting approximately 2 milliliter to approximately 4 milliliter of a humidity control agent through a first end of a capsule and into a space within the capsule, the capsule comprising a sidewall enclosing the space, the side wall extending approximately 1 to approximately 3 centimeters between the first end and a second end, the first end being open; and then sealing the capsule by coupling an endcap to the sidewall at the first end, wherein the endcap is vapor permeable and liquid impermeable, the endcap having a width of approximately 1 centimeter to approximately 2 centimeters; and arranging the humidity control device in a cylindrical single cigar container.

9. The method of claim 8, wherein the humidity control agent comprises approximately 0.5 gram to approximately 2 grams of a liquid, gel, powder, or tablet.

10. The method of claim 8, wherein sealing the filled capsule comprises coupling an endcap to the capsule.

11. The method of claim 8, further comprising exposing the sealed capsule to an environment with at least 20% relative humidity.

12. The humidity control device of claim 1 wherein the first material is stiffer than the second material.

13. The method of claim 8 wherein the endcap is porous.

14. The method of claim 8 wherein the single cigar container has a height of approximately 5 inches and a diameter of less than 1 inch.

15. The method of claim 14 further comprising enclosing the humidity control device in the single cigar container with a single cigar.

* * * * *